US008678652B1

(12) United States Patent
Nattrass

(10) Patent No.: US 8,678,652 B1
(45) Date of Patent: Mar. 25, 2014

(54) STACKABLE, FLEXIBLE, INTERMEDIATE BULK BAG CONTAINER HAVING CORNER BAFFLES

(75) Inventor: David Nattrass, Crystal Lake, IL (US)

(73) Assignee: Bulk Lift International, Incorporated, Carpentersville, IL (US)

( * ) Notice: Subject to any disclaimer, the term of this patent is extended or adjusted under 35 U.S.C. 154(b) by 236 days.

(21) Appl. No.: 13/114,912

(22) Filed: May 24, 2011

(51) Int. Cl.
*B65D 33/02* (2006.01)

(52) U.S. Cl.
USPC ..... 383/119; 383/67; 383/903

(58) Field of Classification Search
USPC ..... 383/38, 40, 105, 117, 119, 67, 24, 903
See application file for complete search history.

(56) References Cited

U.S. PATENT DOCUMENTS 4,493,109 A * 1/1985 Nattrass ..... 383/7
5,071,025 A * 12/1991 Boots ..... 229/117.35
5,158,369 A * 10/1992 Derby ..... 383/67
5,222,812 A * 6/1993 Cuddy et al. ..... 383/17
5,289,937 A * 3/1994 Boots ..... 220/9.1
5,316,387 A * 5/1994 Polett et al. ..... 383/119
5,328,267 A * 7/1994 Cuddy et al. ..... 383/17
5,328,268 A * 7/1994 Lafleur ..... 383/119
5,468,528 A * 11/1995 Schnaars et al. ..... 428/35.7
5,538,155 A * 7/1996 Hoekstra ..... 220/495.01
5,556,205 A * 9/1996 Gallie et al. ..... 383/24
5,564,833 A * 10/1996 Proffitt ..... 383/22
5,649,767 A * 7/1997 Nickell et al. ..... 383/17
5,664,887 A * 9/1997 LaFleur ..... 383/119
5,685,644 A * 11/1997 Taylor ..... 383/24
5,873,655 A * 2/1999 Echeverria ..... 383/119
5,934,807 A * 8/1999 Futerman ..... 383/105
6,010,245 A * 1/2000 Ross et al. ..... 383/119
6,015,057 A * 1/2000 Stone et al. ..... 220/9.2
6,095,688 A * 8/2000 Nittel et al. ..... 383/105
6,109,785 A * 8/2000 Ross et al. ..... 383/117
6,196,719 B1 * 3/2001 Brown ..... 383/109
6,220,755 B1 * 4/2001 Brown et al. ..... 383/119
6,328,470 B2 * 12/2001 Brown et al. ..... 383/119
6,331,077 B1 * 12/2001 Nickell ..... 383/119
6,402,378 B1 * 6/2002 Shackleton ..... 383/119
6,467,955 B1 * 10/2002 Kim ..... 383/20
6,565,256 B2 * 5/2003 Derby et al. ..... 383/119
7,794,148 B2 * 9/2010 Derby et al. ..... 383/119
2001/0038722 A1 * 11/2001 Stone ..... 383/119
2001/0041023 A1 * 11/2001 Brown et al. ..... 383/119
2002/0008517 A1 * 1/2002 Derby et al. ..... 324/318
2002/0021846 A1 * 2/2002 Nickell ..... 383/119
2002/0048415 A1 * 4/2002 Derby et al. ..... 383/119
2003/0056473 A1 * 3/2003 Matias ..... 53/469
2003/0068103 A1 * 4/2003 Levi ..... 383/119
2003/0194159 A1 * 10/2003 Derby et al. ..... 383/119
2004/0081374 A1 * 4/2004 Richardson et al. ..... 383/38
2004/0151404 A1 * 8/2004 Richardson et al. ..... 383/16
2004/0184679 A1 * 9/2004 Williamson et al. ..... 383/38
2005/0105833 A1 * 5/2005 Levi ..... 383/105
2005/0129336 A1 * 6/2005 Richardson et al. ..... 383/16
2005/0180663 A1 * 8/2005 Richardson et al. ..... 383/24
2005/0196079 A1 * 9/2005 Derby et al. ..... 383/119
2005/0196080 A1 * 9/2005 Stone et al. ..... 383/119
2006/0110074 A1 * 5/2006 Richardson et al. ..... 383/24
2011/0044564 A1 * 2/2011 Lin ..... 383/37

* cited by examiner

*Primary Examiner* — Nathan J Newhouse
*Assistant Examiner* — Peter Helvey
(74) *Attorney, Agent, or Firm* — Booth Udall Fuller, PLC

(57) ABSTRACT

A bulk container bag of a flexible fabric has an essentially cubic configuration wherein vertically extending baffles are provided in the interior corners of the bags to permit the bags to better retain their cubic configuration and to improve stability when filled. The baffles have slits defining flaps, alternatively, apertures and flaps, so that the loose granular material captures the flaps after it is filled in the bulk container bag. A method of filling the bag with granular materials is also provided.

19 Claims, 7 Drawing Sheets

STACKABLE, FLEXIBLE, INTERMEDIATE BULK BAG CONTAINER HAVING CORNER BAFFLES

BACKGROUND OF THE INVENTION

1. Field of the Invention

This invention relates generally to large bags of fabric used to transport and store granular or loose flowable material, and more specifically to flexible intermediate bulk containers having a cubic configuration wherein vertically extending baffles are provided in the interior corners of the bags to permit the bags to better retain their cubic configuration and to improve stability when filled.

2. Background Art

The use of large bags of fabric, commonly called flexible, intermediate bulk containers (FIBCs) or simply bulk bags, has become commonplace for transporting bulk quantities of powdered or granular materials. Bulk bags can be lifted and moved by forklift trucks and other material handling equipment having hooks or tines. The cloth for the bulk bags is usually woven of strong, tape-like man-made plastic fibers (e.g., polypropylene), though natural fibers could be employed. Flexible intermediate bulk containers have come into widespread use for receiving, storing, transporting, and discharging flowable materials of all types, including for example liquids.

Although circular bulk bags are known, bulk bags are often constructed from rectangular panels which are sewn together along their adjacent edges to define a bulk bag which initially has a horizontally square or rectangular cross section, as is shown in bulk bag 210 of FIG. 2. When the bulk bag 210 is filled, the nominal shape of the bag configuration, whether rectangular, square or circular, is achieved. For rectangular-sided bags 210, the bag assumes a cubic or rectangularly shaped figure, as shown. This shape is preferable to a circular shape because stacking of the bags becomes a significantly better and more efficient use of space in that voids between the corners 214 of the bags 210 are minimized. However, bulk bags 210, regardless of whether they have a square, rectangular, or circular cross-section, tend to bulge out at the sidewalls 222 (FIG. 2) when filled due to the outwardly directed pressure imposed by the weight of the lose granular and flowable bulk bag contents pressing against the flexible fabric sidewalls 222.

Bulk bags bulging in the center of the sidewalls lead to problems when filled bags are placed side by side. More space becomes necessary between bags with bulging sidewalls than between bags that have planar sidewalls and square corners. The problem is increasingly pronounced when bags are stacked vertically as the weight of the added stacked bags compresses the material in the bags below adding to the internal outward pressure of the material in the bags. Various methods have been considered to address the bulging bags, including use of baffles for providing additional lateral support to the corners of bags when the bags are filled thereby inhibiting tension at the central portions of the sidewalls, and thereby reducing bulging.

For example, U.S. Pat. No. 4,903,859 discloses a bulk bag comprising four double layer sidewalls attached to each other at their boundaries. Stiffeners formed from cardboard are inserted between the layers of the sidewalls thereby imparting sufficient rigidity to the container to permit its use with liquids. Although bulk bags made according to the '859 patent have been in use for some time, their use has been somewhat limited by the challenges encountered in stacking the bags.

U.S. Pat. No. 5,076,710 discloses a baffle-type bulk bag 210, as shown in FIG. 2, wherein bridge panels or baffles 212 are sewn across the four corners 214 of a nominally rectangular bulk bag. The baffles 212 reduce the bulging of the sidewalls 222 outwardly when the bulk bag is filled, thereby retaining the filled bulk bag 210 in a more or less rectangular cross-sectional configuration. The baffles have cut-out apertures 218 which allow loose granular material to flow into and out of the corners 214 of the bulk bag 210 during filling and discharging operations. However, as described below, the type and size of apertures 218, and the lack of reinforcing fabric in the apertures 218, rather than just between the apertures 218 at the fabric web 220, do not provide for as strong a web of fabric in the baffles 212 at the corners 214. This results in the formation of bulges and waves on the side wall surfaces 222 of the bulk bags 210 because of the uneven tension when viewed in the horizontal direction horizontally across the baffle webs 220 caused by the aperture cut-outs 212. The result can be seen in the shape of bulk bags 210 as shown in the perspective view of FIG. 4, whereupon after filling of the bags 210, the sidewalls 222 produce bulges 224 at the vertical positions where the baffles 212 have an aperture 218 and produce undulating indentations 226 at those vertical positions along the bag walls 214 which are adjacent the web portions of the baffle 212.

U.S. Pat. No. 5,468,528 describes a FIBC with baffles having triangular apertures. The corner, baffle and sidewalls are connected to each other along the vertical edges of the baffle. This construction is stated as providing a more efficient stitching operation for when a plastic or polyethylene liner is provided internally in the bag inner walls to seal the interior from moisture and other unwanted contaminants. However, the configuration adds to the complexity of manufacturing processes and diminishes the available uninterrupted side wall surface on the bags for the stencilling of company names or other identifying information or other means of identification on the bag sidewalls.

U.S. Pat. No. 5,564,833 discloses a lined bulk bag, i.e., a FIBC, having sidewalls of a flexible material and baffles across the corners to maintain a square configuration. The liner baffles are claimed to impart a "square" configuration to the FIBC. The liner is described as being a polyolefin sheet material baffle-type bulk bag wherein bridge panels or baffles are sewn across the four corners of a nominally rectangular bulk bag. The liner is disclosed as being impervious to air and moisture. The lined bulk bag disclosed in this patent includes apertures having diamond shapes with an apex of the diamond in a lowermost position.

In U.S. Pat. No. 6,283,470, a baffle-type bulk bag is described having reinforcing triangular stiffener supporting members positioned in the corners of the bulk bag to provide lateral support and to facilitate stacking of filled bulk bags. The stiffeners may be formed from various materials including plastic panels, panels formed from corrugated paperboard and similar materials, etc. The stiffeners may be provided with apertures aligned with the apertures of the baffles thereby permitting the flow of material into and out of the bulk bag during filling and discharging operations. The stiffener inserts are not flexible, being made of rigid plastic, so that the bags do not completely collapse when empty, making transport of unfilled bags cumbersome.

Other baffle style bags are described in U.S. Pat. Nos. 5,203,633; 5,468,528; 6,015,057; 6,220,755; and 7,794,148, each of which provide for different mechanisms or designs that attempt to solve the problem of bulging bags. However, for the most part those designs that utilize baffles create a new problem in impairing the filling and discharging of dry or granular material from the corners of the bulk bags. Prior to the present invention, bulk bags without large apertures were used for ease of transport and storage of dry, loose granular material. One example of these bags 110 are shown in a perspective view in FIG. 1. Bulk bags 110 are typically shipped on pallets 120, and include loops 112 adjacent an upper surface 114, the loops 112 being used for ease in moving the bags 110 to and from different storage and transport locations. The bulging sidewalls 116 are evident in bag 110 of FIG. 1, since no lateral side supports are present to distribute the load on the flat bag sidewall panels 116. When the bags are stacked (not shown) the sidewalls 116 of bulging bags 110 result in fewer bags being able to be stored in the same amount of space, in that the bulging sides walls 116 will require more distance between bag centers because the bulging sides create a larger "footprint" taking up more floor space because of the gaps created between the sidewalls of adjacent bags. Moreover, these types of bags were susceptible to shifting and internal movement of the contents during shipment, leading to instability in the bag configuration.

Bulk bags with configurations that use baffles with large apertures, as shown in two additional prior art bags 210, 310 in FIGS. 2 and 3, however, produce a different set of problems. Use of baffles 212, 312 with large apertures 218, 318 cannot provide uniform lateral support to the sidewalls 222, 322, thereby causing undulations 224, 226 in the sidewalls 222 of filled bags 210, as can be seen in bulk bag 210 shown in the perspective view of FIG. 4. Most of these apertures 218, 318 have width and length dimensions that result in large open areas between the strips 212, 312 of the fabric web that comprise the baffle elements, the width and length dimensions being determined by the necessity to efficiently move the material into and out of the bag corners 214, 314, defined by adjoining walls 222, 322, during filling and discharge.

Removal of the material from between the apertures 218, 318 decreases the ability to control the tension provided to the bag structure by the baffles 212, 312 and provides corners 214, 314 resulting from the baffle structures 212, 312 that do not fully isolate the bag contents in the corners 214, 314. Specifically, since the tension is concentrated in the strips 212, 312 of the baffle web, that is, between the cut-outs or apertures, 218, 318, there is no tension or other horizontal or lateral structural support that can be provided by the structure at the position of the cut-outs 218, 318 at the specific points where the web fabric of baffles 212, 312 is attached to the sidewalls 222, 322. This results in undulations from the indents 224 (FIG. 4) at the places where there are strips in 212, and protuberances 226, where there are apertures 218, in the sidewalls 222 of the bags 210 (FIG. 4) due to the uneven tension on the sidewalls 222 provided by the baffles 212, 312. That is, uneven tension is directed at the places where the sides of baffles 212 are attached to the sidewalls 222, and that tension is directed to discrete areas of the sidewalls 222 that are being pulled together by strips 212 while adjacent areas including the cut-outs or apertures 218 are providing the uneven lateral support. Uneven tension makes for weaker bags since there is a greater force continuously being applied to the sides of the bags. Additionally, if the filled bags are being shipped or transported, shifting of the material in the bags 210 caused by movement of the bags can increase or decrease the amount of tension on the sidewalls provided by the large apertures in baffles 212, 312 thereby providing uneven tension which over time weakens the sidewalls 222. At the top of the corner 214 adjacent the loop 208, there may develop a loose or turned over portion 228 due to the lack of material in the upper part 117 of the corner that leads to a less than square appearance. Moreover, large apertures 218, 318 provide large openings which fail to inhibit internal shifting of the loose granular contents during shipment between the corner volume and the interior volume.

Referring again to FIG. 4, the undulations caused by the troughs 226 and protuberances 224 cause large wrinkles in the sidewalls 222, as shown, that give a less than neat appearance to logos, company names, trademarks and labels that are stencilled or affixed to the outer surfaces of sidewalls 222, 322 of the bags, and make the bags less appealing to customers. The unseemly appearance of such bags makes them less desirable to the recipients of the filled bags, and thus also less desirable to the customers of the bag manufacturers.

U.S. Pat. No. 5,873,655 appears to recognize the problem caused by large apertures in baffles. It discloses the use of spaced apart parallel strips of fabric 312 across the corners 314 of a bulk bag 310 as shown in FIG. 3. The spaces between parallel strips permit granular materials to flow into the corners 314 of the bags 310. However, it appears that the bulk bags disclosed by U.S. Pat. No. 5,873,655 have not been successful in the marketplace because of the complexity and added steps required by adding separate strips which need to be sewn into the walls defining the bag corers. Additionally, it is likely that the bags of U.S. Pat. No. 5,873,655 still suffer from the problems of uneven tension at the apertures the use of strips 312 since their use does not solve the uneven tension problem, as described above. Also, it is likely that the bags of U.S. Pat. No. 5,873,655 probably cost more produce due to the cost of joining many strips to the bag sidewalls.

SUMMARY OF THE INVENTION

To provide a better construction for a bulk loading a FIBC bag, the present invention discloses and claims in a first embodiment a flexible container bag assembly comprising an exterior body of flexible material including a plurality of sidewalls attached to each other at the edges of adjacent sidewalls, the sidewalls defining corners at the position of attachment of the sidewall edges to define bag corners, and a bottom panel having plural bottom panel boundary edges, the bottom panel boundary edges being attached to the sidewall edges not attached to each other, thereby providing an enclosed interior volume configuration capable of retaining loose or granular material and lifting loops at or immediately adjacent at least two of the bag corners, a plurality of baffles comprising a web fabric, one baffle spanning each of the corners defined by the sidewall edges, the baffle having an essentially rectilinear shape, one longitudinal edge of each baffle being attached to a sidewall and the other longitudinal baffle edge being attached to an adjacent sidewall thereby defining a corner volume, the two longitudinal baffle edges defining between them a width w of a baffle, each baffle having at least two apertures in the web fabric of the baffle, the width of each aperture being less than the width w of the baffle, the apertures in the web fabric permitting access between the interior volume and the corner volumes, the baffles thereby assisting to maintain the rectangular configuration of the container and a flap at least partially covering the at least two apertures.

The at least two apertures each have a geometrical shape with at least one side being comprised of an aperture edge that is defined by a fabric attaching the flap to the web material of the baffle can comprise a substantially triangular, trapezoidal, or circular segment-like shape. Preferably, the first aperture is substantially an inverted triangle. Preferably, the inverted triangle has a bottom included angle in a range of between 120° to 150° of the two sides that comprise the edges of the flap. The at least two apertures can have a width that is in a range of between 58% to 75% of the width of the baffle containing the aperture and a height that is in a range of between 15% to 28% of the width w of the baffle containing the aperture. Preferably the at least two apertures and the flap covering each aperture, when in a closed position, are preferably defined by a slit in the web fabric of the baffle to form the geometrical shape of each flap.

The flexible container bag assembly can have additional flaps which cover or partially cover additional apertures, respectively, in at least one of the baffles. The plurality of apertures can be substantially aligned in a column. The additional apertures can be substantially identical in shape. Adjacent apertures can have a distance between the top of one aperture and the bottom of the next adjacent aperture in a range of between 70% to 130% of the height of the any aperture, and the plural apertures may be equally spaced apart from each other, although some variance in this configuration may accommodate the greater stresses that are expected for the apertures closer to the bottom panel.

Most preferably, each of the four baffles has at least two flaps and two apertures, which flaps are formed by making a slit of appropriate shape in the fabric the baffle web. Each of the four baffles can also have plural baffle apertures, each covered by flaps, respectively. The plural apertures can be substantially aligned in a column and may be substantially identical in shape, and have even spacing in the vertical direction between adjacent flaps. Alternately, the spacing between the lower apertures may be slightly larger than those of the top apertures to provide additional tensile resistance to accommodate the heavier weight acting on the baffle at the lower positions due to the weight of the material in the bag above them.

In another embodiment, the invention provides a flexible container bag assembly. The bag assembly has an exterior body including plural sidewalls of flexible material, corners to define a rectangular configuration and lifting loops at or immediately adjacent the corners. The bag assembly has baffles to maintain the rectangular, configuration. At least one of the baffles has a first slit. The first slit is preferably a rectilinear shape and has at least one bend and is oriented in an upwardly concave orientation relative to the bottom panel. Each first slit can form a flap in the at least one baffle. The slit is preferably substantially v-shaped so as to define a triangular flap having an apex and an included angle in a range of between 120° to 150°, although an included angle of approximately 135° is preferred. The baffle can also have multiple slits that are preferably substantially aligned in a vertically ascending configuration.

In another embodiment, the invention provides a method of filling a flexible container bag with loose granular material having the characteristics described above. The container bag has an exterior body including plural sidewalls of flexible material and corners to define a rectangular configuration. The baffles and sidewalls form an interior volume in the container bag. The baffle has a first flap covering or partially covering the aperture(s). The method includes placing sufficient granular materials into the interior volume to cause the granular materials to flow through the aperture and push the first flap away from the interior volume and into the corner volume, after which additional material being deposited from another aperture disposed above the first flap fixes the first flap in position to inhibit shifting of material within the corner of the bag. The inventive method is repeated for each additional flap of the plural apertures disposed above the first aperture, that is, those apertures further from the bottom panel, to fix the horizontal and vertical positions of each baffle, and thereby to inhibit shifting of the contents in the container bags during shipment and storage of the materials filling the bags.

The inventive container bags can also include multiple apertures above the first aperture. The method may provide for placing additional granular materials into the interior volume in a quantity sufficient to cause the granular materials to flow through the multiple apertures and onto the first flap and additional flaps covering apertures below the one through which material flows to achieve the feature of fixing the flaps and thus the baffle web in position. Ideally, the flap is fixed so as to inhibit motion of the flap in the vertical direction by the tension and frictional forces of the granular material, which provides frictional pressure as it presses on and holds the flap in position. The inhibition of the flap movement also serves to inhibit vertical motion of the baffle web since the base of each flap is attached to the baffle, and thus the static nature of the baffle web and the flaps also inhibits shifting of the loose granular contents of the bag.

The present invention is an improvement over the prior art providing a baffle-type bulk bag, making the inventive bags more easily, stackable, and better able to maintain the bag square or cubic shape under pressure from the granular material in the container bag. The sidewalls remain relatively flat, when compared to conventional baffle type bulk bags, even when there is pressure of bags stacked above it either in a transport vehicle or when stacked on solid ground. The more planar smooth-surfaced sidewalls make for a more attractive presentation for affixing or printing of company logos, company names, trademarks and labels all of which reflect on the goodwill of the customer buying the bags from manufacturer, and which are placed on the bag. The bags are also stronger as tension across the baffles is more evenly distributed along the vertical sides of the corners, rather than in discrete spots. More significantly, the bags maintain the loose granular materials in place and using the inventive baffles, inhibit shifting of the materials during shipment and storage thereof in the bags when they are being moved or stacked in place.

BRIEF DESCRIPTION OF THE DRAWINGS

The present invention will now be discussed in further detail below with reference to the accompanying figures in which:

FIG. 6B is a detailed sectional view of the portion of the inset box view of FIG. 6A;

DETAILED DESCRIPTION OF THE PREFERRED EMBODIMENTS

Figure 7A:
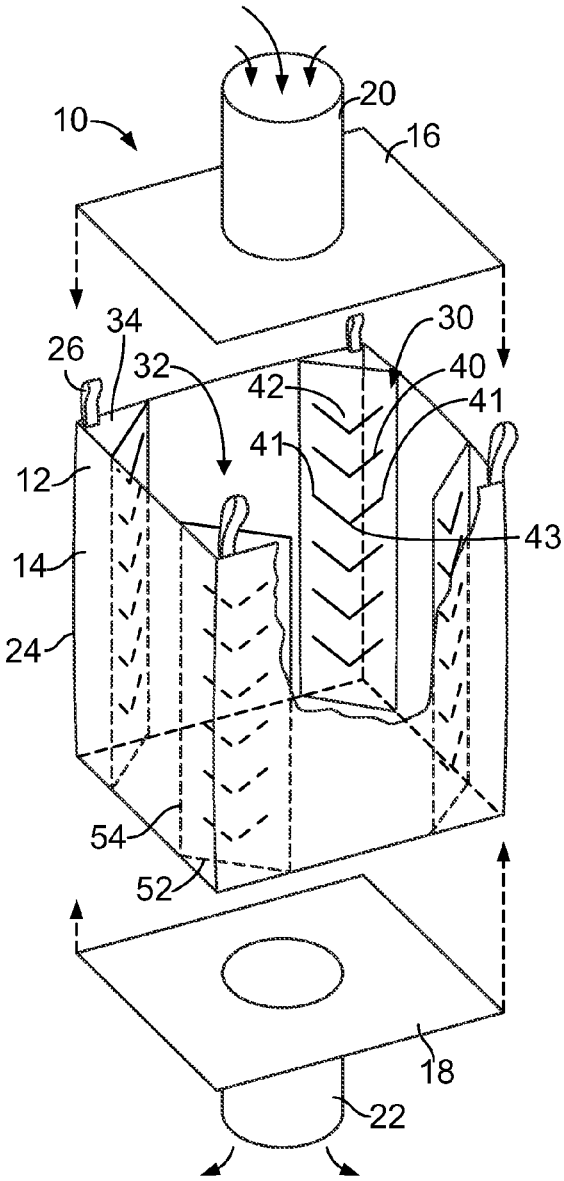
FIGS. 7A and 7B are exploded views of different embodiments of container bags of the invention.
Figure 7B:
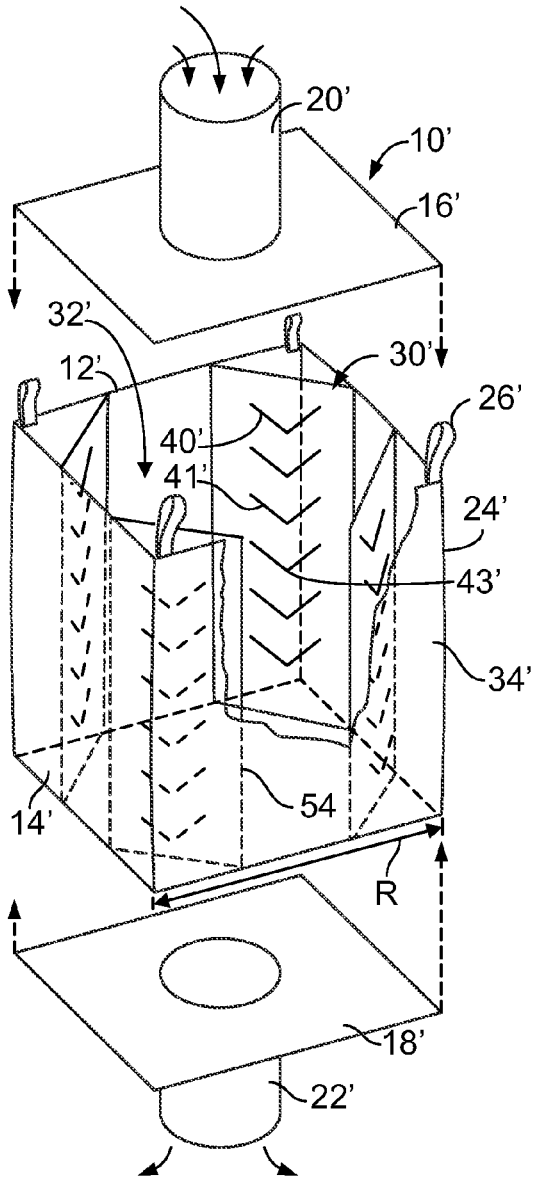
Figure 8:
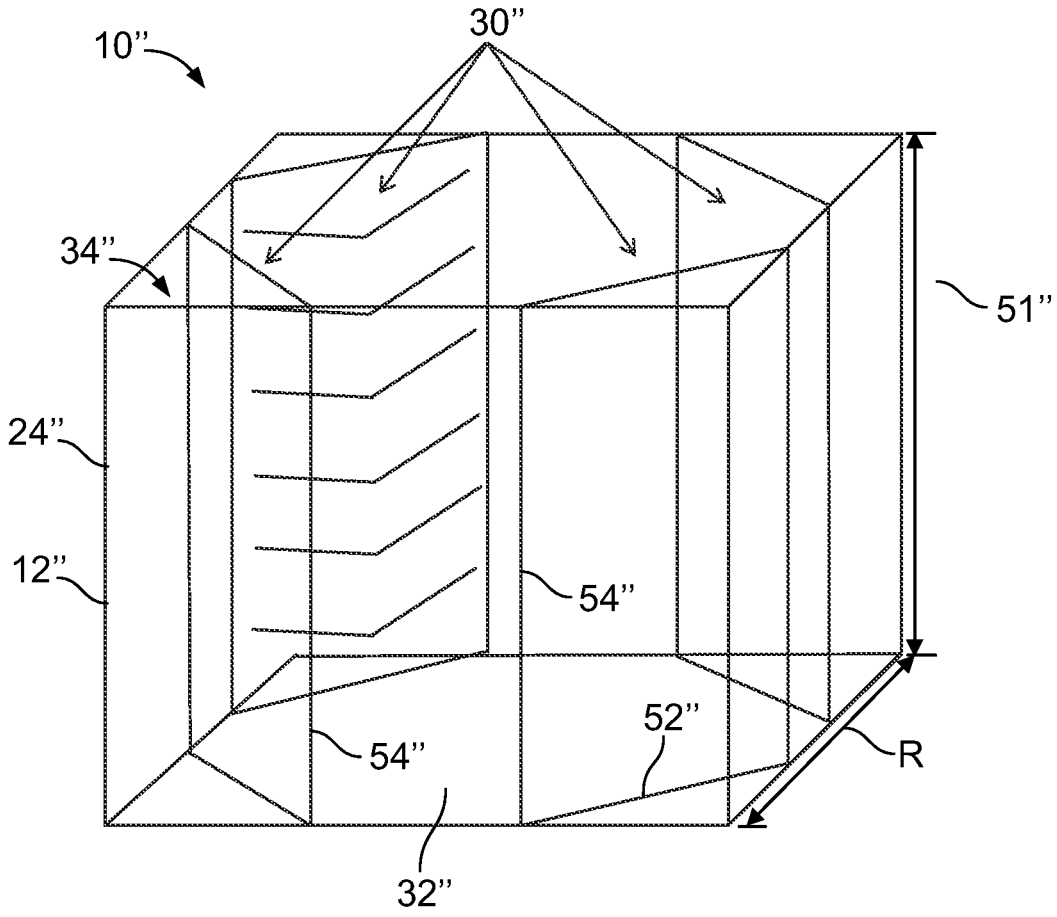
FIG. 8 is a schematic view of a container bag of the invention.
Figure 9:
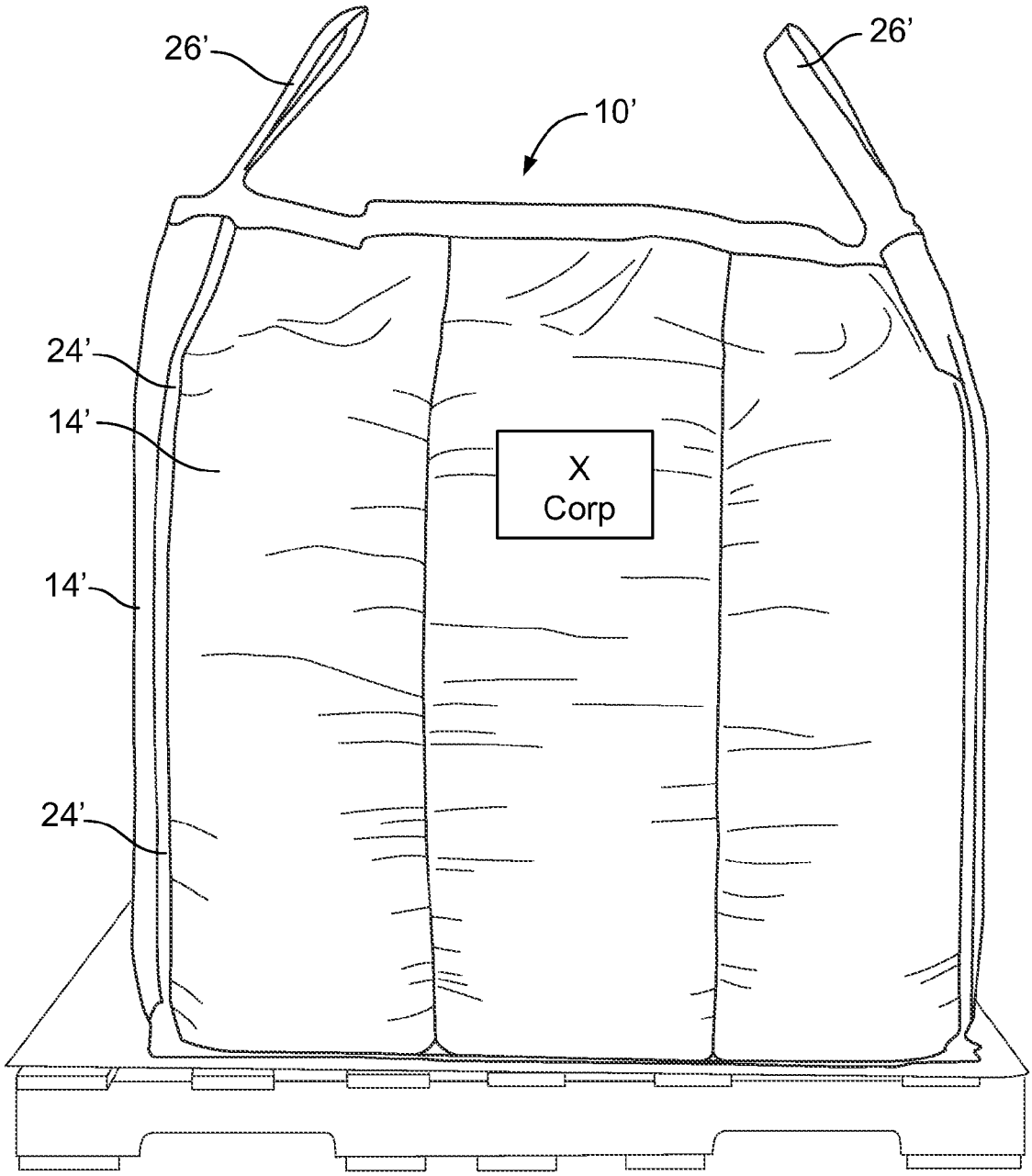
FIG. 9 is an elevational perspective view of a container bag according to the invention containing granular materials in a stored condition.

Several different embodiments of the bulk container bags 10, 10' and 10" according to the present invention are illustrated in FIGS. 7A, 7B, 8 and 9. The three bags 10, 10', 10" shown in FIGS. 7A, 7B and 8, respectively, are essentially identical, with the significant exception of the width of the baffle liners 30, 30', 30" being the main difference, as will be explained below in greater detail. FIG. 9 shows in a perspective view a filled container bag 10' made in accordance with the configuration shown in FIG. 7B, where the edges of the baffle 30' are each about one third of the width R from each corner 24' of the bag 10', as is explained in greater detail below.

The bags in FIGS. 7A and 7B are shown in exploded, cutaway views for ease in illustration, but the assembled bags provide complete enclosures for the contained loose granular material that is stored within, as is known, and the only ingress and egress for the loose aggregate material is provided through the fill tubes 20, 20' and the discharge tubes 22, 22'. The schematic view of FIG. 8 indicates the outlines of the bag sidewalls 14" and the baffles 30", showing the extension of the baffle connections to the sidewalls 14" further from the corners 34" and closer to the central portion of each sidewall 14".

Referring now to FIG. 7A, bag 10 has an exterior body 12 including sidewalls 14, top portion 16 and bottom panel portion 18. Sidewalls 14 preferably have a rectangular configuration or cross-section, most preferably square, although octagonal or other volume shapes may be possible. Exterior body 12 is cubic, preferably square cubic, wherein the boundary edges of the bottom panel portion 18 are attached, preferably by sewing, to the bottom edges of each sidewall panel, as shown. Bottom panel portion 18 has a discharge tube 22. The edges of adjacent sidewalls are attached to each other to provide an enclosed container 10 having an internal volume 32 capable of holding and storing a loose or granular material, such as are known in FIBC industry. Top portion panel 16 is also attached to the top edges of sidewalls 14 and has a fill tube 20. Tubes 20 and 22 facilitate the filling and discharge of bag 10. Bag 10 has four corners 24, located at the extremes of the sidewalls 14, where adjacent sidewalls 14 are joined to each other at their edges forming corners 24. At or immediately adjacent corners 24 at a top portion closest to the fill tube 20 are lifting loops 26 used to lift the filled bags with a crane or fork lift truck in the normal processes used for transport and storage.

Bag 10 has at least one baffle 30, preferably 2, more preferably 3, and most preferably 4 or more, depending on the shape of the bag. Baffles 30 are preferably located across bag corners 24 and extend from one side wall, to which they are attached, to another sidewall attachment at a centrally located position in the sidewalls. Ideally, the attachments comprise stitch lines extending along vertical lines in the same relative position of the sidewalls 14, although it is possible that baffles that are rectilinear and not perfectly rectangular, for example, can have a wider baffle distance w (see FIG. 5) at the bottom than at the top of the baffle 30. Baffles 30 and sidewalls 14 with top portion 16 and bottom portion 18 of bags 10 define an interior volume 32 and a plurality of corner volumes 34 disposed between the bag corners 24 and the baffles 30. A standard fill tube 20 and discharge tube 22, which are both generally cylindrical, communicate, preferably directly, with interior volume 32 to permit the bag to be filled and emptied of the contents being stored in the bag 10.

Corner volumes 34 are separated from interior volume 32 by the web fabric comprising baffles 30. Corner volumes 34 generally have a triangular cross section for cubic bags; preferably the horizontal cross-section is substantially an isosceles triangle having a substantially square angle with the corner 24' at the apex of the triangle. Preferably, baffles 30 are attached to sidewalls 14 in a symmetrical layout. Specifically, as shown in FIG. 7A, baffles 30 attach to sidewalls 14 approximately a quarter way along the width of sidewalls 14. In FIG. 7B, baffles 30' attach to sidewalls 14' approximately a third of the way along the width R of sidewalls 14'. Preferably, baffles have a width w that is in a range of from 30% to 60% of the width R of sidewalls, as shown in the various embodiments of bags 10, 10' and 10" in FIGS. 7A, 7B and 8, respectively, as is discussed in greater detail with relation to the baffle 30 shown in FIG. 5. The preferable configuration for most materials to be transported is the one in which the The length or optimal amount extension of the baffle connection to the sidewall 14 is mostly variable and may depend on the type and expected weight, density and other physical characteristics of the material that will be filling in the bag. For example, in instances where all the material must be discharged from the bag, e.g., because the material is deleterious, the material must be removed before the bag can be disposed of. Thus, it may be necessary to have the baffles 30" as shown in FIG. 8 to give the material in the corner volumes 34" more freedom of motion so as to enable their travel to the discharge tube, as will be explained in greater detail below. The connection points may be required to be at points closer to the corners 32, as shown in FIG. 7A, for example, when the material tends to clump together and to coalesce in the corners 34.

Referring again to FIG. 5, each baffle 30 preferably has multiple apertures 40, each aperture 40 being covered by an overlaying flap 42. The number of apertures 40 in a baffle 30 can be any number, e.g. 1, 2, 3, 4 or more, for example, commensurate with the function provided by the apertures, and the number of corners available in the three dimensional enclosure defined by the sidewalls and other panels. Baffle 30 has a corresponding number of flaps 42 overlying the each of the apertures 40. Flaps 42 cover or essentially cover apertures 40 when the web of baffle 30 is in a vertical position, e.g., just before filling of the material in the bag 10. The preferred method of creating aperture 40 and flap 42 is to simply cut a slit having two cut lines 44*a*, 44*b*, the slit having an appropriate shape to provide a flap 42. The flap can 42 be any shape, such as square, rectangular, or semicircular or semi-oval. However, a triangular shape, including a bend or point 43 at which the two side section cut lines 44*a*, 44*b* of the slit 44 meet is preferred. Specifically with respect to one of the flaps 42, for ease of description, aperture 40 is described in the form of a triangular shape that may be attached to the fabric web of baffle 30 at a base that is part of the fabric web of baffle 30 until the slit lines 44*a* and 44*b* are cut. Thus, when flap 42 is in its closed position overlying the aperture 40, for example before the loading of the material in the container bag 10, the slit forms the triangular flap 42. Other alternative methods of attaching a flap are possible, for example, cutting a flap from a different web material, and attaching it by stitching to a web in which apertures have been precut. However, this method although feasible, is not preferred because it adds to the steps required to make the web and also adds to the costs of production.

Baffle 30 may include preferably six slits 44, and maybe even more if the material is very fine. The number of slits 44 and apertures 40 is only limited by the capability of the baffle web fabric to maintain its integrity when the gravitational and stress forces of the filling material act on the web of the baffles 30 and on the sidewalls 14. The number of slits may be optimized according to the type and characteristics of the filling material. Appropriate shapes of the slits 44, that is, the shape, size and angle of the slit 44 and the flap 42 may be altered or modified to achieve the objectives of the present invention.

Slits 44 are upwardly convex, that is, they each have two essentially straight cuts 44*a* and 44*b* that converge toward a central location at a point 43. Preferably, slits 44, being formed by cut lines in the fabric or web comprising baffle 30, define flaps 42 that essentially cover each of the apertures 40. The slit cut in one side of each aperture 40 creates flaps 42, as seen in greater detail in the cross-sectional view of FIG. 6A, and the flaps are then provided for in an efficient manner.

Apertures 40 and flaps 42 may be substantially triangular, trapezoidal, or circular segment-like. Generally, slits 44 are upwardly concave. Apertures 42 preferably have a substantially triangular shape with a bottom point 43 of convergence where the two sides 44*a* and 44*b* meet. Each of the points 43 of adjoining slits 44 preferably are along a longitudinal centerline CL of the baffle 30. An included interior angle $\alpha$ of 120° to 150°, preferably 130° to 140° and most preferably approximately 135° is formed between the two cut lines 44*a* and 44*b*. Preferably all the apertures 40 have an identical or similar shape, although it is conceivable that the shape of dimensions of the slits may vary depending on their relative vertical position in the height of the baffle 30.

Slits 44, and the end of the flap 42 also preferably may be in the shape of a V-like or triangular shaped bottom, with the apex or point 43 of the triangle at the lower most point (closest to the bottom panel) when the baffle 30 is sewn into position in the corner 12 of the bag 10 (FIG. 7A). The two diagonally extending sides 40*a* and 40*b*, converge at the point 43 to define an identical interior included angle $\alpha$ having a value between 120° and 150°, preferably 130° and 140°, and most preferably approximately 135°. V-shaped slits 44 define the lines 40*a* and 40*b*, which preferably make an angle $\beta$ with a horizontal line or a line parallel to the bottom w of the baffle, which bottom edge will be adjacent to the bottom panel 18 of the bag 10 (FIG. 7A). Angle $\beta$ preferably has a value of about 15° to 30°, more preferably 20° to 25°, and most preferably approximately 22.5°.

Figure 5:
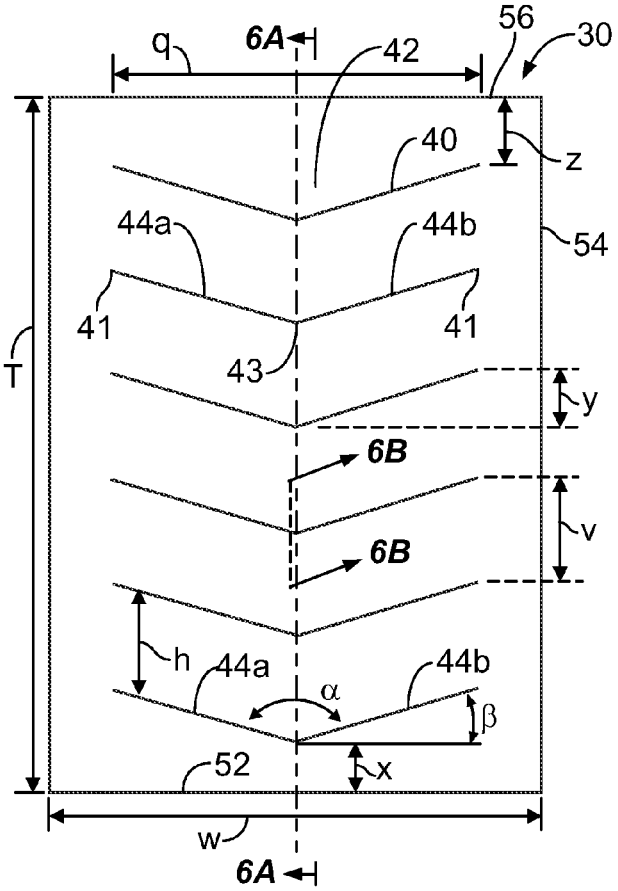
FIG. 5 illustrates a baffle for a container bag pursuant to the present invention.

Apertures 40 may have a width w across the face of the baffle 30 that is between 58%-75%, preferably 63%-70%, and most preferably about two-thirds of width 38 of the baffle 30 containing aperture 40. Aperture 40 may have a height 48 that is 15%-28%, preferably 18%-25%, and most preferably about three fourteenths of width W of baffle 30 containing aperture 40. Depending on the size and dimensions of baffle 30, the width and height of each aperture 40 is of sufficient size that when six apertures are disposed on the baffle 30, as shown in FIG. 5, the baffle surface is serially covered with the apertures 40, each aperture 40 separated by a flap 42, and including some additional fabric between the apertures 40 that provide lateral support to the baffle 30 when the ends are being pulled laterally apart upon loading of the bag 10.

Preferably, first, second, third, fourth, fifth and sixth apertures 40 are substantially aligned in a column, so that the respective convergence points 43 are all centrally located and are disposed preferably along the centerline CL. Preferably, first, second, third, fourth, fifth and sixth apertures 40 are substantially identical in shape. Preferably, the top of one aperture 40 and the bottom of the neighboring aperture 40 is 70%-130% of the height h of the apertures 40 as measured from cut line 44*a* to the adjacent line 44*a* or from point 43 to adjacent point 43. Although the dimensions between the cut lines 44 and points 43 of convergence are shown as being equidistant, again this is only a preferable configuration, and it may be preferred to have greater distance between the apertures 40 disposed at the bottom, that is, closest to the bottom wall 18 (FIG. 6A) so as to accommodate the greater stresses that will develop at the bottom of the pile of granular material 132 that has the increased weight of the additional material 132 above it. This may add to the attention necessary to attaching the baffles 30 to the sidewalls 14 of the bags 10, but may provide sufficient benefit to implement this optional feature to warrant the need of extra attention. Also, the points of convergence may be staggered, that is, the points 43 may not necessarily be aligned along a common centerline, as shown, if it is found that for a particular material that is stored, a staggered configuration may better inhibit shifting within the bag and may provide a better means to contain the material within the volumes.

Referring again to FIGS. 6A and 6B, as each of the apertures 40 are inundated by the level of granular material 132 flowing into the bag 10, each flap becomes anchored in place by the frictional tension provided by the granular material 132, so as to provide a much more stable load and more equivalent tension of the baffles and the sidewalls than was heretofore possible. More importantly, the load of granular material 132 is inhibited from further shifting within the bag 10, or between the inner volume 32 and the corner volumes 34 by the flaps 42, thus maintaining the planar shape of the sidewalls 14, which then present a more planar and pleasing configuration. Additionally, the squareness of the filled bags permit additional packing of more bags per square area as the gaps between the corners are reduced or eliminated.

Referring now to FIGS. 7A, 7B, 8 and 9 generally, the construction of bulk container bags 10 may comprise any suitable method, as in any standard bulk bag. For example, the four sidewalls 14 may be formed from four separate pieces of fabric or from a single tubular piece of fabric, as is known. Bags 10 are generally made from woven or non-woven fabrics or films. Bags 10 may also have a woven exterior fabric and a film liner or coating. Generally, the materials are polyolefins, such as polyethylene or polypropylene. Baffles 30 may or may not be attached directly to top wall panel 16. Preferably, inventive bags 10 do not have a configuration that attaches the baffle bottom edge 52 (FIG. 5) to the bottom panel 18 (FIG. 7A), as then an enclosed space will result in the bottom of corner volume 34 through which the granular material 132 cannot flow out to the discharge tube 22 when the bag is being emptied.

Generally, attachment of sidewalls 14 to each other, of the sidewalls to the bottom 18 and top panels 16, and indeed of the baffles 30 to the sidewalls 14, is completed by stitching. The bulk container bags 10 may be of any size appropriate to perform their function of bulk storage and transport of loose aggregate materials. Typically, the bags are between about 0.25 to 4.0 cubic meters and more are preferably, between about 0.5 to 2.0 cubic meters. The sidewalls of the bags may be about 3 to 4 feet (about one meter) in the vertical and horizontal dimensions. The bag dimensions may be standard or customized depending on the needs of the customer. However, should additional information be needed as to the configuration and manufacture of the bags 10, any above-referenced prior art patent, or alternatively, reference to commonly assigned U.S. Pat. No. 5,415,614 is invited for a more detailed description of known methods, which descriptions are incorporated by reference herein.

It has been found that bags 10, 10', 10" made according to the present invention exhibit straighter or more planar sidewalls and exhibit a much lesser tendency for formation of bulges or waves on the sidewalls 14 than those bags made using standard baffles as discussed above. It is considered that these results are due to more even and uniform horizontal tension forces acting laterally across the baffles 30 than prior art bags having baffles with aperture that are completely cutout. With more uniform tension, the bags 10, 10', 10" of the present invention provide for much better stacking and are to some extent stronger than prior art bags. Conversely, the bags of the invention can be made with fabric having lesser strength than standard baffles and can result in production of bags having the same strength as the prior art. They also provide a neater, straighter appearance for logos and labels placed on the sidewalls 14 bags.

Figure 6A:
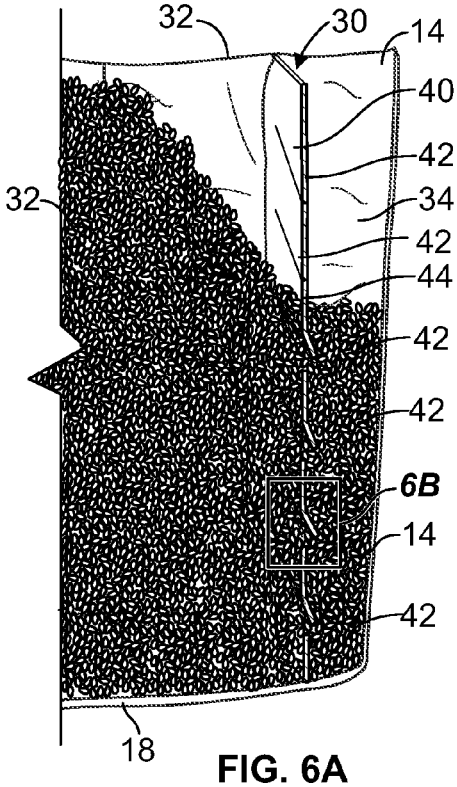
FIGS. 6A and 6B are cross-sectional views of a container bag according to the present invention when the container bag is filled with granular materials, where
Figure 6B:
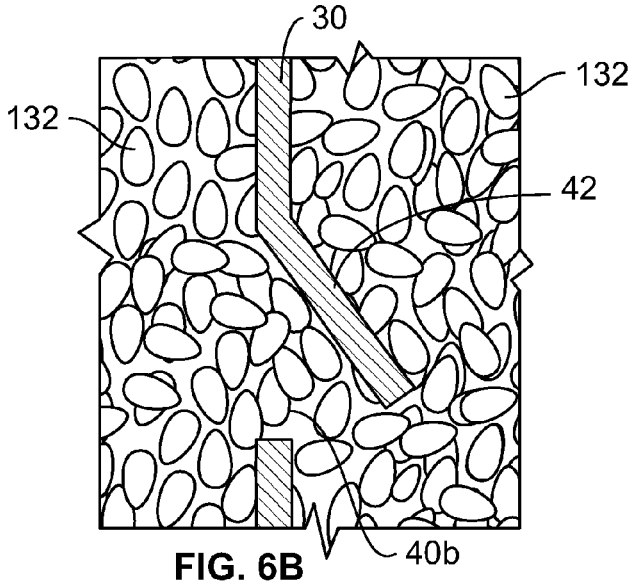

Referring now to FIGS. 6A and 6B, the inventive concept also includes a method of filling container bags 10, 10', and 10" with loose granular materials 132. The method includes charging a flow of granular materials into interior volume 32 sufficient to cause the granular materials in interior volume 32 to rise in level so that it spills out toward the sidewalls 14 and as it reaches the baffles 30 at the corners, the material 132 begins to flow through the first or bottom aperture 40 in each baffle 30 and into the bottom of the corner volume 34 adjacent corner 12. The material then pushes and displaces the first flap 42 covering aperture 40 away from its covering or partially covering function so that the first aperture 40 is opened and permits the granular material 132 to flow from interior volume 32 and into the corner volume 34. As the space in the bottom of the corner volume 34 fills up, the flap is pushed out into the volume 34 by the weight of the material until no more material 132 can flow through the first aperture 40 because the material in volume 32 rises above the top of the aperture 40. When this is completed, the position of the flap 42 becomes fixed in its relative configuration with the web of baffle 30, as is shown in greater detail in FIG. 6B.

The granular material 132 continues to flow into the central main volume 32 continues and the pile to rise, as is shown in FIG. 6A. The bag has a second aperture above the first aperture 40, and as the material reaches the bottom of that aperture, the material 132 begins to flow through that aperture 40 and into the volume 34, as with the first aperture 40. However, because the corner volume 34 has already been filled to a level above the first aperture, and has been overlaid by the first flap 42, the granular material 132 flowing through the upper aperture falls onto the flap 42 of the immediately below aperture 40, and sandwiches the first flap 42 within two layers of granular material 132, one above and one below the flap 42, as shown. Thus, the position of flap 42 becomes fixed and cannot move except with the granular material 132 in the corner. That is, the flap 42, and also the web of the baffle 30 becomes constrained from being displaced, either vertically or horizontally, because of the frictional force acting on the flap by the loose granular material under pressure from the weight of the material above and below it.

The method preferably also includes placing additional granular materials into the interior volume in a quantity sufficient to cause the granular materials to flow through the second aperture and onto the first flap. The method may also include placing additional granular materials into the interior volume in a quantity sufficient to cause the granular materials to flow (1) through a third aperture onto a second flap for covering or partially covering the second aperture, (2) through a fourth aperture onto a third flap for covering or partially covering the third aperture, (3) through one aperture onto a flap for covering or partially covering a lower aperture, and (4) through a top aperture onto a flap for covering or partially covering an aperture below the top aperture as is considered appropriate for a specific configuration of a baffle 30.

A significant feature of the invention can be seen in FIGS. 6A and 6B. FIGS. 6A and 6B show cross-sections of bag 10 that has been partially filled with granular materials in accordance with the method of the invention described above. FIG. 6A shows four flaps 42 which have been pushed away from interior volume 32 and into corner volume 34 by the flow of granular material and which are surrounded by granular material both below and above each of the four flaps 42. FIG. 6B is a magnified view illustrating one flap 42 inundated and surrounded by granular material 132. It is believed that flaps 42 are frictionally fixed by the granular material 132 and flaps 42 help transmit horizontal forces across width W of baffles 30 by flaps 42 being by granular material. It is believed that the frictional fixing of flaps 42 provides significant advantages of the invention over the use of simple apertures, without a flap 42, taught by prior art patents disclosing use of baffles. Namely, the bags of the invention result in straighter sides, provide more stable volumes for containing the loose aggregate materials 132 and thus can be more easily stored and stacked, provide additional lateral support to the sidewalls than do prior art bags and can handle more weight than prior art bags, all as a result of the benefits of the flap configuration and the frictional forces acting thereon. Conversely, the bags of the invention can be made with a reduced strength in the web fabric of the baffles to achieve a bag of the same strength as the prior art at a reduced cost. The straighter sides provide a neater, straighter appearance for logos, company names, trademarks and labels placed on the bag.

REPRESENTATIVE EMBODIMENTS

Referring again to the baffle 30 illustrated in FIGS. 5 and 7A, which are referenced for illustrative purposes only, since any of the three embodiments 10, 10' 10" in FIGS. 7A, 7B and 8 can be used. Baffle 30 can be in use for standard or tall versions of a bulk container bag 10. For a baffle 30 with a nominal height t of approximately 37 inches there will be optimally six slits 40 defining an "upside down" triangular flap 42 with a downwardly disposed apex or point 43 (FIG. 5) and an attached base defined between the lateral ends points 41 of the triangular flap 42. Ideally, the height t of the baffle 30 will be slightly shorter than the height of the bag, as measured at the corner. seam 24, (FIG. 7A) so as to leave some clearance between the bottom panel 18 and the bottom, edge 52. Preferably, and for purposes of efficiency of operation, the bottom edge 52 is not attached to the bottom panel. Some clearance, perhaps about ½ or 1 inch, is needed between the two elements (18 and 52) to permit complete discharge of loose aggregate material from the corner volumes 34 of the bag when the main volume 32 is being emptied. That is, as the bag is emptied, the clearance allows the loose granular material to slip out from under the bottom edges 52 of the baffle 30 and find their way to the discharge tube 22. This avoids the trapping of any of the material in the bottom of corner volumes 34, which would occur if there was stitching connecting the baffle edge 52 to bottom panel 18.

The width w of the web of baffle 30 ideally is about 21 inches, but the width will depend on the type of baffle stitching desired. If the vertical stitching connecting the baffle 30' to the sidewall 14' is desired in the preferred location, one third of the width R (R is normally about 37 inches) of the sidewall 14' as shown in FIG. 7B, then the appropriative width w of the baffle 30 will be about 21 inches, leaving a short folded over hem to provide for the attachment of the vertical baffle edges 54 to the sidewall 14'. If the location of the attachment of baffle edges 54 to sidewall 14' is desired closer to the corner seams 24, as in FIG. 7A, then the width w of the baffle 30 will be smaller, for example between 15 and 20 inches, as desired. Of course, for the more centrally located stitches shown in bag 10" in FIG. 8, the baffle width w should be larger, of from 22 to about 30 inches, to enable it to span the diagonal length between the two sidewalls 14" defining the corner volumes 34". Alterations and modifications of the dimensions of the baffle connections to the sidewalls are possible and should be considered as disclosed herein so as to provide the options for customizing the bags as need by a particular customer.

The dimensions of the slits 40 forming triangular flaps 42 also may be variable, and may also be customized to accommodate the specific carrying capacity of a particular customer's loose aggregate material desired to be stored in the bag. A nominal dimension of the height y, defined as the vertical profile of the slit 40 extending from apex point 43 to the lateral end 41 of the slit 40, may be about 3 inches in a standard bulk bag 10', as shown in FIGS. 5 and 7B, but may be larger or shorter depending on the included angle $\alpha$ defined by the lines 44*a* and 44*b* of slits 40. An appropriate width q as measured in the horizontal direction between the two ends 41 of a slit 40 may also vary depending on the width R of the bag and the width w of the baffle 30. However, a width of about 14 inches for a baffle width of 21 inches is considered to provide sufficient strength to the configuration to achieve the purposes of this invention.

The bottom aperture 40 preferably is spaced at a height x of about 2 inches or more from bottom edge 52 of baffle 30. A top aperture 40 may also be spaced at a height z at least 2 inches from top edge 56 of baffle 30. Adjacent apertures may be spaced at a height v at least 3 inches from each other, and preferably 6 inches apart to provide some web fabric between the slits defining apertures 40. As shown in FIG. 5, baffle 30 has six apertures 40, six flaps 42 and six slits 44. Additional slits 40 and flaps 42 or a reduced number thereof may be utilized depending on the desired strength of the web of baffle fabric and other considerations.

In a larger version of bulk container bag, for example, one in which the side seams 42 are about 40 or more inches, the baffles 30 may have a height t of approximately 39 inches and width W of about 21 inches. Also, the height y of an individual aperture 40 may again be 3 inches and have a lateral width q of 14 inches. However, the distance between the slits 40 may be from 3 to 3.6 inches apart, so as to provide additional support form the baffle web between the apertures. Baffle 30 has six apertures 40, six flaps 42 and six slits 44.

Figure 1:
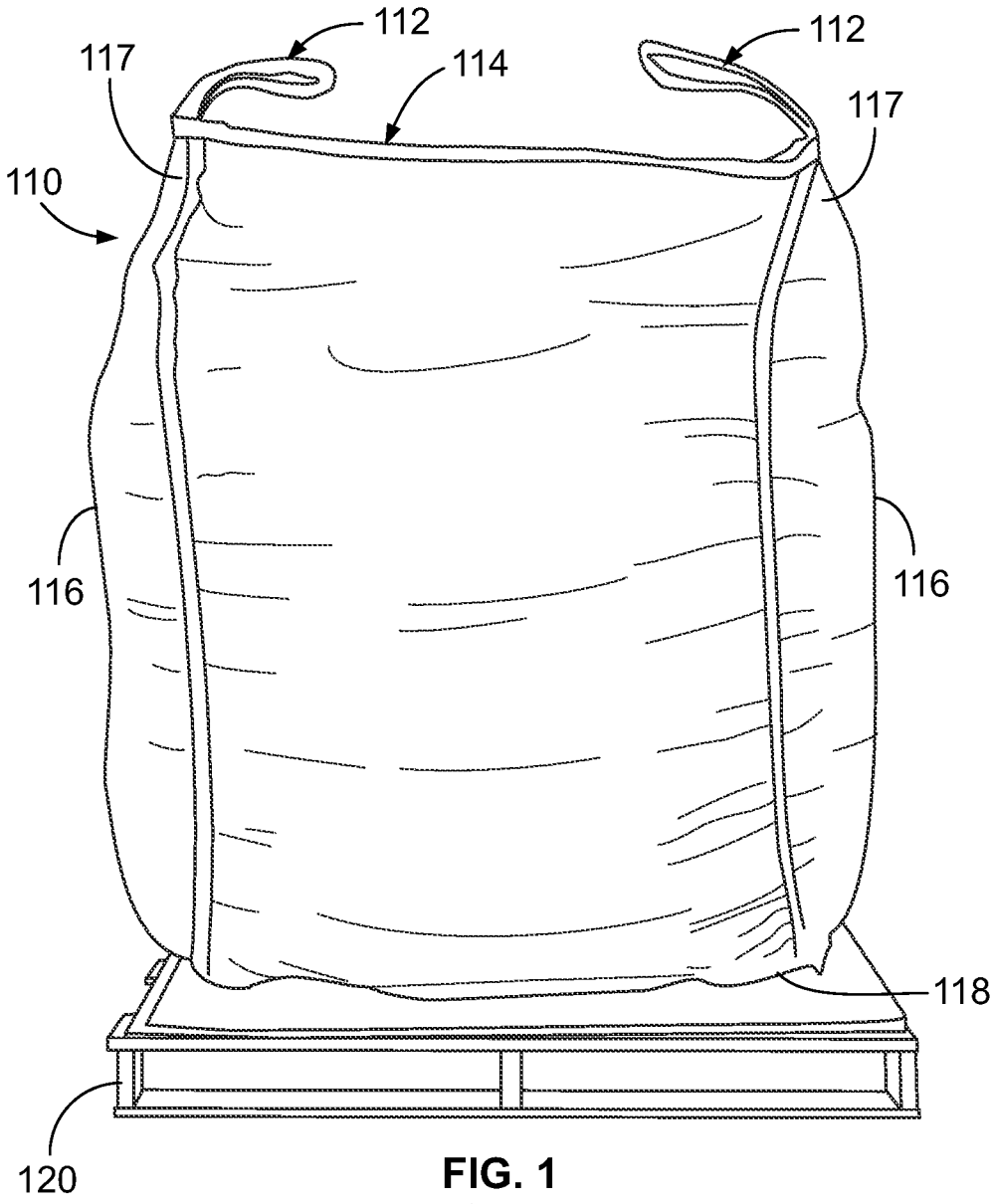
FIG. 1 PRIOR ART
FIG. 1 is a perspective view illustrating a prior art container bag without baffles.
Figure 3:
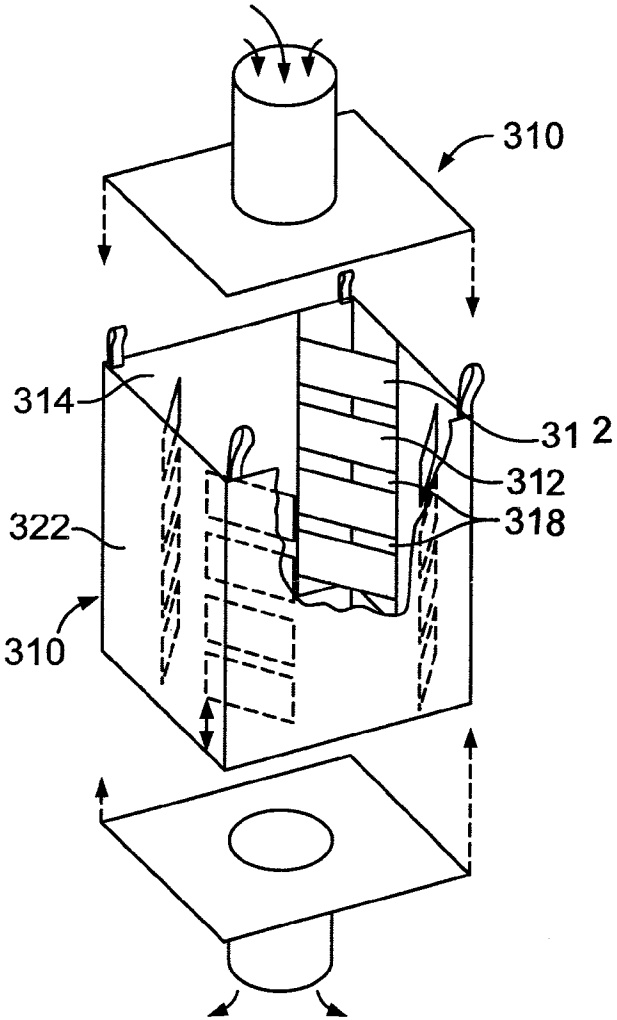
FIG. 3 PRIOR ART
FIG. 3 is an exploded schematic view of a second prior art container bag structure illustrating use of internal baffles.
Figure 2:
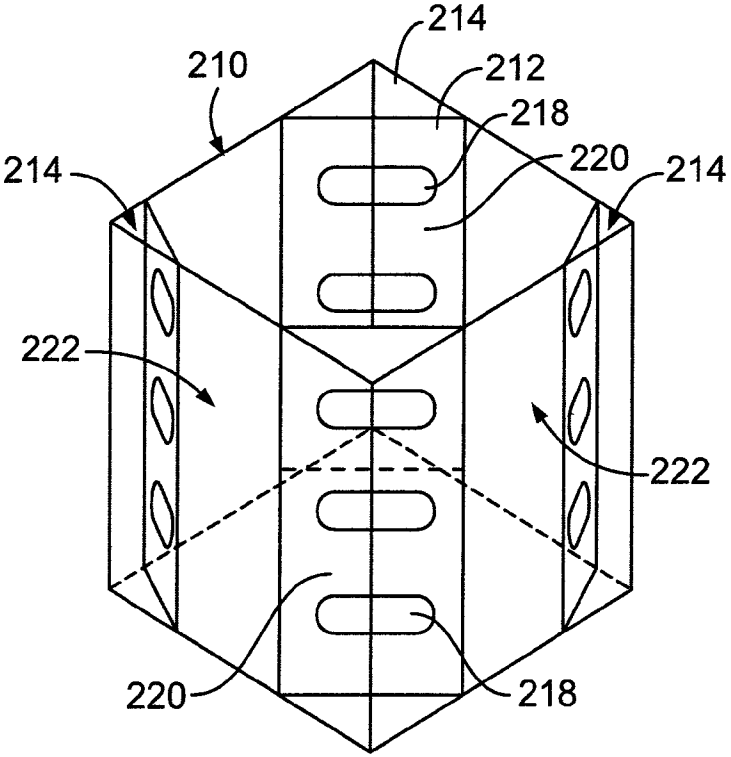
FIG. 2 PRIOR ART
FIG. 2 is a schematic view of a first prior art container bag structure illustrating use of internal baffles having apertures.
Figure 4:
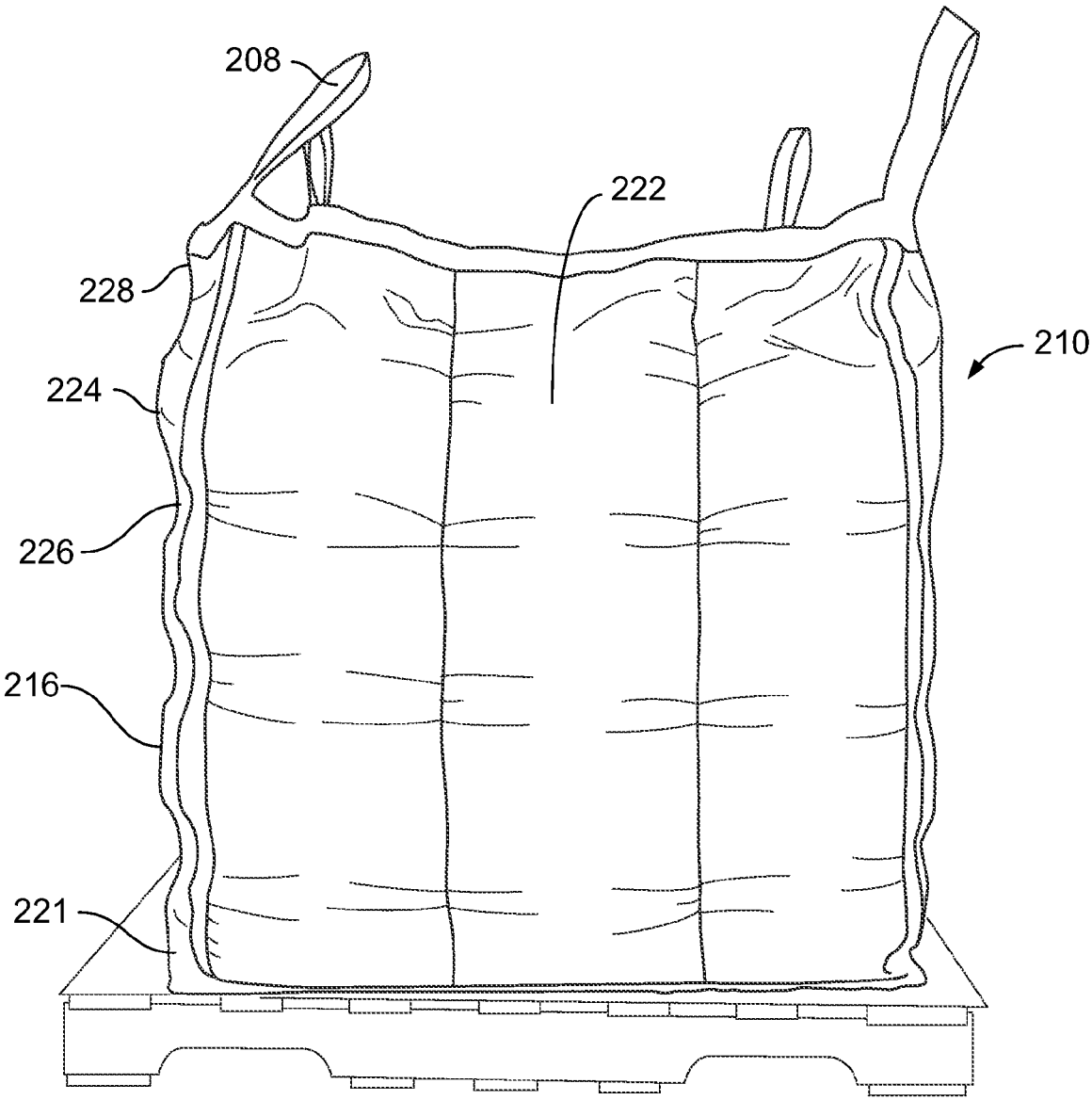
FIG. 4 PRIOR ART
FIG. 4 illustrates in a perspective view of a prior art container bag having baffles with apertures showing the results of uneven tension crated by apertures in the baffles.

Referring now to FIG. 9, a perspective view of a bulk container bag 10' according to the present invention is shown in a filled state. As can be seen from the profile view of the two sides 14', these are smooth and have little or no undulations or bulges, such as those bulges in the sides 116 of the prior art bags shown in FIG. 1, or the waves 224 and undulations 226 as in the sides 216 of the prior art baffle bags shown in FIG. 4. Thus, inventive bulk container bags 10' according to the present invention are capable of presenting a smoother surface for placement of company logos thereon, as shown in FIG. 9, and can provide a more square profile that avoids gaps between bags when two or more are loaded onto transport vehicles or placed on a floor space adjacent each other.

While the invention has been described with respect to certain preferred embodiments, as will be appreciated by those skilled in the art, it is to be understood that the invention is capable of numerous alterations, changes, modifications and rearrangements and such alterations, changes, modifications and rearrangements are intended to come within the scope of the following claims.

What is claimed is:

1. A flexible container bag assembly comprising:

an exterior body of flexible material including a plurality of sidewalls attached to each other at the edges of adjacent sidewalls, the sidewalls defining corners at the position of attachment of the sidewall edges thereby defining bag corners, and a bottom panel having plural bottom panel boundary edges, the bottom panel boundary edges being attached to sidewall edges not attached to each other, thereby providing an enclosed interior volume configuration capable of retaining loose or granular material and including lifting loops at or immediately adjacent at least two of the bag corners;

a plurality of baffles comprising a web fabric, one baffle spanning each of the bag corners defined by the sidewall edges, the baffle having an essentially rectilinear shape, one longitudinal edge of each baffle being attached to a sidewall and the other longitudinal baffle edge being attached to an adjacent sidewall thereby defining a corner volume, the two longitudinal baffle edges defining between them a width w of a baffle, each baffle having at least two apertures in the web fabric of the baffle, the width of each aperture being less than the width w of the baffle, the apertures in the web fabric permitting access between the interior volume and the corner volumes, the baffles thereby assisting to maintain the rectangular configuration of the container; and at least one flap at least partially covering each of the at least two apertures, each flap comprising a flap base attached to the web fabric and a flap bend or point opposite the flap base that is not directly attached to the web fabric.

2. The flexible container bag assembly of claim 1 wherein the at least two apertures each have a geometrical shape with at least one side being comprised of an aperture edge that is defined by a fabric attaching the flap to the web material of the baffle.

3. The flexible container bag assembly of claim 2 wherein the at least one aperture is substantially an inverted triangle when the baffle is installed in an upright container bag, the triangle comprising an apex defined by two converging cut lines, the apex being disposed lowermost and the base of the inverted triangle comprising an edge wherein the fabric attaches the flap to the web material of the baffle.

4. The flexible container bag assembly of claim 3 wherein the triangle has an included angle in a range of from 120° to 150° between the two cut lines.

5. The flexible container bag assembly of claim 3 wherein the triangle has an included angle of about 135° between the two cut lines.

6. The flexible container bag assembly of claim 1 wherein each aperture has a width that is in a range of from 58% to 75% of the width w of the baffle containing the aperture.

7. The flexible container bag assembly of claim 1 wherein each aperture has a height y that is in a range of from 15% to 28% of the width w of the baffle containing the aperture.

8. The flexible container bag assembly of claim 1 further comprising baffles having plural apertures, each aperture being covered by flaps.

9. The flexible container bag assembly of claim 8 wherein the plural apertures are substantially aligned in a column extending longitudinally along the length of the baffle.

10. The flexible container bag assembly of claim 8 wherein the plural apertures are substantially identical in shape and are spaced from each other by a same distance.

11. The flexible container bag assembly of claim 8 wherein a second aperture is adjacent to the at least one aperture and a distance between the top of the aperture and the bottom of the next adjacent aperture is in a range of from 70% to 130% of the height of the at least one aperture.

12. The flexible container bag assembly of claim 1 wherein the at least one aperture further comprises a slit in the baffle web material, the slit comprising at least two cut lines.

13. The flexible container bag assembly of claim 1 wherein the at least one of the baffles comprises six baffles.

14. A flexible container bag assembly comprising:

an exterior body including plural sidewalls of flexible material, corners to define a rectangular configuration and lifting loops at or immediately adjacent the corners;

plural baffles adjacent the corners to maintain a rectangular configuration of the flexible container bag; and at least one of the baffles having a slit, the slit being upwardly concave and defining a flap that substantially covers the aperture, the flap being defined by the upwardly concave slit.

15. The flexible container bag assembly of claim 14 wherein the slit is substantially v-shaped.

16. The flexible container bag assembly of claim 14 wherein the first slit has an included angle in a range of from 120° to 150°.

17. The flexible container bag assembly of claim 16 wherein the first slit has an included angle of about 135°.

18. A flexible container bag assembly comprising:

an exterior body including plural sidewalls of flexible material, corners to define a rectangular configuration and lifting loops at or immediately adjacent the corners;

a baffle adjacent at least one of the corners, comprising an aperture, and coupled to the exterior body to maintain the rectangular configuration of the flexible container bag; and a flap that covers the aperture, wherein the flap comprises a base attached to the baffle and a cut bend or point opposite the flap base.

19. The flexible container bag assembly of claim 18 wherein the aperture is defined by at least one upwardly concave slit that further defines a flap that partially covers the aperture.

* * * * *